US012116759B1

(12) United States Patent
Ding

(10) Patent No.: US 12,116,759 B1
(45) Date of Patent: Oct. 15, 2024

(54) DOUBLE-HANDLE FAUCET

(71) Applicant: Danxuan Ding, Ningbo (CN)

(72) Inventor: Danxuan Ding, Ningbo (CN)

( * ) Notice: Subject to any disclaimer, the term of this patent is extended or adjusted under 35 U.S.C. 154(b) by 0 days.

(21) Appl. No.: 18/510,631

(22) Filed: Nov. 15, 2023

(30) Foreign Application Priority Data

Oct. 10, 2023 (CN) ..... 202322717582.2

(51) Int. Cl.
*E03C 1/04* (2006.01)

(52) U.S. Cl.
CPC ..... *E03C 1/0403* (2013.01); *E03C 1/0412* (2013.01)

(58) Field of Classification Search
CPC ..... E03C 1/0412
USPC ..... 4/695
See application file for complete search history.

(56) References Cited

U.S. PATENT DOCUMENTS 8,991,425 B2 * 3/2015 DeVries ..... E03C 1/0403 4/695
2011/0073205 A1 * 3/2011 Marty ..... E03C 1/0403 137/801

* cited by examiner

*Primary Examiner* — Lauren A Crane

(57) ABSTRACT

The present disclosure provides a double-handle faucet, comprising a water outlet assembly, a control unit and a pipeline assembly; wherein, the water outlet assembly comprises a water outlet pipe, a water outlet spout, a first mounting base, a connecting core body and a first sleeve, the first sleeve is sleeved outside the connecting core body, the first mounting base is sleeved outside the first sleeve and the connecting core body, and the water outlet pipe is provided at the first end of the connecting core body; the control unit comprises two handle assemblies, the handle assemblies comprise a handle, a second mounting base, a valve core and a second sleeve respectively, the second sleeve is sleeved outside a copper core and a plastic core, the second mounting base is sleeved outside the second sleeve, the copper core and the plastic core, the plastic core is provided with a fluid inlet port and a fluid outlet port, a connection/disconnection between the fluid inlet port and the fluid outlet port can be controlled by operation of the handle; the pipeline assembly comprises a hot water inlet pipe, a cold water inlet pipe and a quick connecting pipe. The double-handle faucet of the present disclosure has good anti-scalding and anti-freeze-cracking effect, and has low production cost and high corrosion resistance.

9 Claims, 7 Drawing Sheets

DOUBLE-HANDLE FAUCET

TECHNICAL FIELD OF THE INVENTION

The present disclosure relates to the technical field of kitchen and bathroom equipment, in particular to a double-handle faucet.

BACKGROUND OF THE INVENTION

At present, the double-handle faucets on the market are usually equipped with two control valves, one for controlling hot water and the other for controlling cold water. Due to the independent setting of the cold and hot water switches, they are favored by users for their convenient operation. To prevent excessive heavy metals in water, traditional faucets mostly use copper or stainless steel materials to achieve the goal of lead-free. However, copper and stainless steel have higher prices, high production costs, and long production times, resulting in high costs and low product competitiveness. And at the hot control valve end, the water temperature is too high and easy to scald, and when the temperature is below 0° C., both hot and cold valve cores (or spools) are very easy to freeze and crack, and the cold and hot valve cores are susceptible to corrosion and failure due to the influence of water quality.

SUMMARY OF THE INVENTION

In order to overcome the shortcomings of the existing technology, the present disclosure aims to provide a double-handle faucet, which has good anti-scalding and anti-freeze-cracking effect, and has low production cost and high corrosion resistance.

The purpose of the present disclosure is realized by using the following technical solution:

A double-handle faucet, comprising:

a water outlet assembly, comprising a water outlet pipe, a water outlet spout, a first mounting base, a connecting core body and a first sleeve, a water outlet channel being provided in the connecting core body, the first sleeve being sleeved outside the connecting core body, and a first end of the connecting core body being exposed from the first sleeve, the first mounting base being sleeved outside the first sleeve and the connecting core body, and the first sleeve and the connecting core body being connected with the first mounting base respectively, the water outlet pipe is provided at the first end of the connecting core body and connected to the water outlet channel, the water outlet spout is provided at one end of the water outlet pipe away from the connecting core body;

A control unit, comprising two handle assemblies, the handle assemblies comprising a handle, a second mounting base, a copper core, a plastic core, and a second sleeve respectively, the second sleeve being sleeved outside the copper core and the plastic core, the copper core being arranged over the plastic core, the copper core and the plastic core both being threadedly (i.e. in a threaded manner) connected to the second sleeve, the second mounting base being sleeved outside the second sleeve and the plastic core, and being threadedly (i.e. in a threaded manner) connected to the second sleeve, the plastic core is provided with a fluid inlet port and a fluid outlet port, the copper core is partially exposed from the second sleeve and is connected to the handle, so that a connection/disconnection between the fluid inlet port and the fluid outlet port can be controlled by operation of the handle;

A pipeline assembly, comprising a hot water inlet pipe, a cold water inlet pipe and a quick connecting pipe; a quick connecting pipe having three connectors, namely a first connector, a second connector, and a third connector; the first connector being connected with the second connector and third connector respectively, the first connector being connected with a second end of the connecting core body, the second connector and the third connector being connected with the fluid outlet ports of two plastic cores respectively; the fluid inlet ports of two plastic cores are connected to a hot water inlet pipe and a cold water inlet pipe respectively.

Wherein, the first mounting base and the second mounting base are made of zinc alloy, and the first sleeve and the second sleeve are made of stainless steel.

Further, the connecting core body is made of plastic.

Further, the first sleeve and the connecting core body are threadedly (i.e. in a threaded manner) connected to the first mounting base.

Further, a bottom surface of the first mounting base and the second mounting base are provided with an annular groove, a spacer is provided in the annular groove, the height of the spacer is greater than the depth of the annular groove.

Further, the water outlet pipe is sleeved on the first end of the connecting core body and three first sealing rings are provided between the connecting core body and the water outlet pipe, and one first sealing ring is provided between the connecting core body and the first mounting base.

Further, the connecting core body is provided with an opening circlip, the opening circlip is provided between the connecting core body and the water outlet pipe.

Further, a second sealing ring is provided between the plastic core and the second sleeve, and a third sealing ring is provided between the copper core and the second sleeve.

Further, the handle is a cross handle, the cross handle is made of zinc alloy.

Further, the handle is a circular arc handle, the circular arc handle comprises a handle connector and a handle straight rod, the handle connector is connected to the copper core, the handle connector is made of zinc alloy and the handle straight rod is made of stainless steel.

Further, a locking nut is threaded outside the first sleeve and the second sleeve respectively, the locking nut is able to move in its own axial direction when twisted, at least two flathead screws are connected on the locking nut in a threaded manner, and the small end of the flathead screw provided on the first sleeve is set toward the first mounting base, and the small end of the flathead screw provided on the second sleeve is set toward the second mounting base, a silicone washer and a stainless steel washer stacked on top of each other are sleeved outside the first sleeve and the second sleeve, and the stainless steel washer is closer to the flathead screw; the pipeline assembly further comprises a hot water inlet pipe and a cold water inlet pipe, and the fluid inlet ports of two valve cores are connected to the hot water inlet pipe and the cold water inlet pipe, respectively.

Compared with the existing technology, the present disclosure has the following advantageous effects:

Plastic core is made of plastic, so when the hot water flows through the plastic core, it can play the role of thermal insulation, thus reducing the risk of scalding by the handle, that is, with a certain degree of anti-scald effect. And plastic core corrosion resistance is good, and the plastic core is not easy to be affected by the water quality and to be oxidized and corroded. In addition, due to the use of plastic core, when the temperature is below Zero degrees Celsius, the plastic core is not easy to freeze and crack, and has a better anti-freezing effect. The second mounting base, the first mounting base and the handle are made of zinc alloy (i.e., metal shell and plastic core), which can ensure the structural strength of the double-handle faucet of the present disclosure, and the second sleeve of the stainless steel material is wrapped around the plastic core, so that the plastic core can be free from the external force when installing, that is, it plays a role in protecting the plastic core, and at the same time, metal shell and plastic core can also make the production cost lower.

In the Figures: 1, water outlet assembly; 11, water outlet pipe; 12, first mounting base; 13, connecting core body; 14, first sleeve; 15, water outlet spout; 151, thread locking structure; 152, bubbling structure; 153, waterspout spacer; 2, control unit; 21, handle assembly; 211, handle; 2111, handle connector; 2112, handle straight rod; 212, second mounting base; 2131, fluid inlet port; 2132, fluid outlet port; 2133, copper core; 2134, plastic core; 214, second sleeve; 3, pipeline assembly; 311, first connector; 312, second connector; 313, third connector; 32, hot water inlet pipe; 33, cold water inlet pipe; 41, annular groove; 42, spacer; 51, first sealing ring; 52, second sealing ring; 53, third sealing ring; 61, opening circlip; 62, wear-resistant plastic ring; 71, screw; 81, locking nut; 82, flathead screw; 83, silicone washer; 84, stainless steel washer.

DETAILED DESCRIPTION OF THE PREFERRED EMBODIMENT

In order to facilitate the understanding of the present disclosure, the present disclosure will be more fully described below with reference to the relevant accompanying drawings. Preferred embodiments of the present disclosure are given in the accompanying drawings. However, the present disclosure can be realized in many different forms and is not limited to the embodiments described herein. Rather, these embodiments are provided to enable a more thorough and comprehensive understanding of the disclosure of the present disclosure.

It is noted that when an element is the to be "fixed to" another element, it may be directly on the other element or there may be an intermediate element. When an element is the to be "connected" to another element, it may be directly connected to the other element or there may be an intermediate element. The terms "vertical","horizontal","left", "right" and similar expressions are used herein for illustrative purposes only.

Unless otherwise defined, all technical and scientific terms used herein have the same meaning as commonly understood by those skilled in the art of the present disclosure. Terms used herein in the specification of the present disclosure are for the purpose of describing specific embodiments only and are not intended to limit the present disclosure. The term "and/or" as used herein includes any and all combinations of one or more of the relevant listed items.

Figure 1:
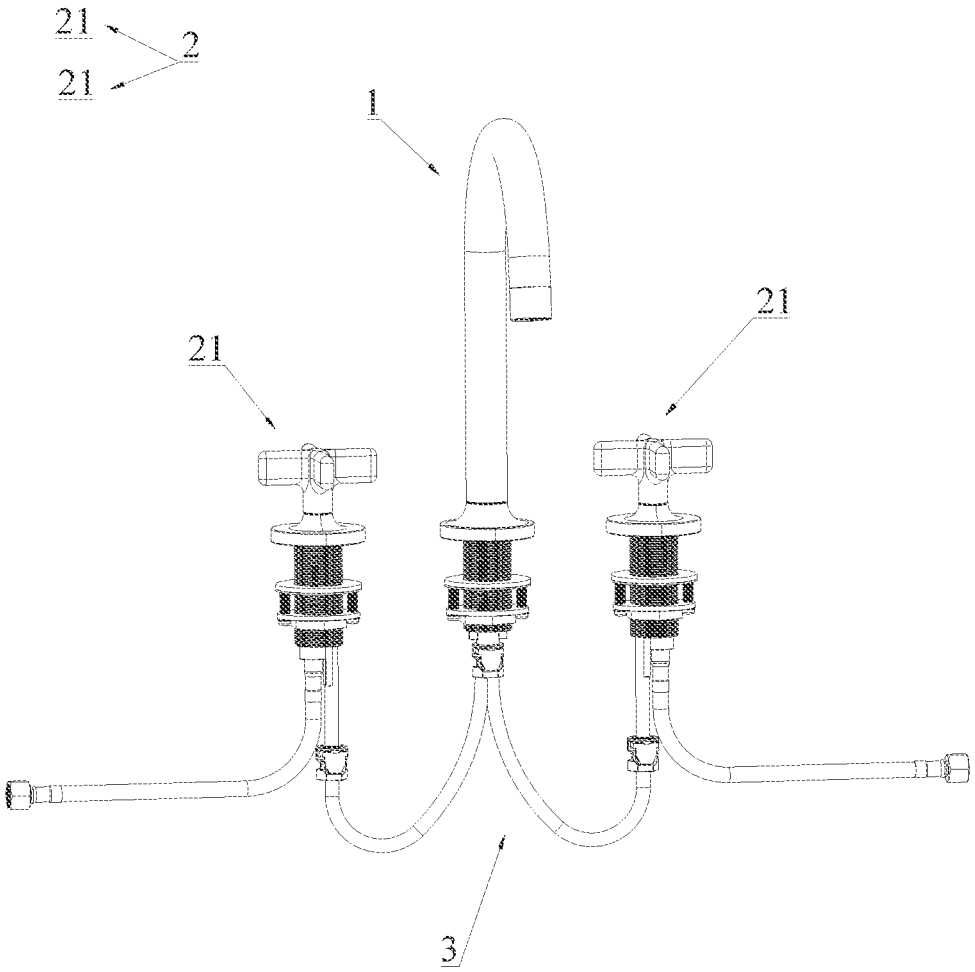
FIG. 1 shows a three-dimensional schematic view of the double-handle faucet of the present disclosure.

As shown in FIG. 1, a double-handle faucet provided by an embodiment of the present disclosure is illustrated, which comprises at least a water outlet assembly 1, a control unit 2 and a pipeline assembly 3.

Referring to FIGS. 1-4, the water outlet assembly 1 comprises a water outlet pipe 11, a water outlet spout 15, a first mounting base 12, a connecting core body 13 and a first sleeve 14; a water outlet channel 131 is provided in the connecting core body 13, the first sleeve 14 is sleeved outside the connecting core body 13, and a first end of the connecting core body 13 is exposed from the first sleeve 14, the first mounting base 12 is sleeved outside the first sleeve 14 and the connecting core body 13, and the first sleeve 14 and the connecting core body 13 are connected with the first mounting base 12 respectively, the water outlet pipe 11 is provided at the first end of the connecting core body 13 and connected to the water outlet channel 131. The water outlet spout 15 specifically includes a thread locking structure 151 connected to the water outlet pipe 11, a bubbling structure 152 arranged in the thread locking structure 151 and a waterspout spacer 153. In actual installation, the first mounting base 12 and the water outlet pipe 11 are arranged above the basin (washbasin), and the first sleeve 14 is arranged below the basin (washbasin).

Figure 2:
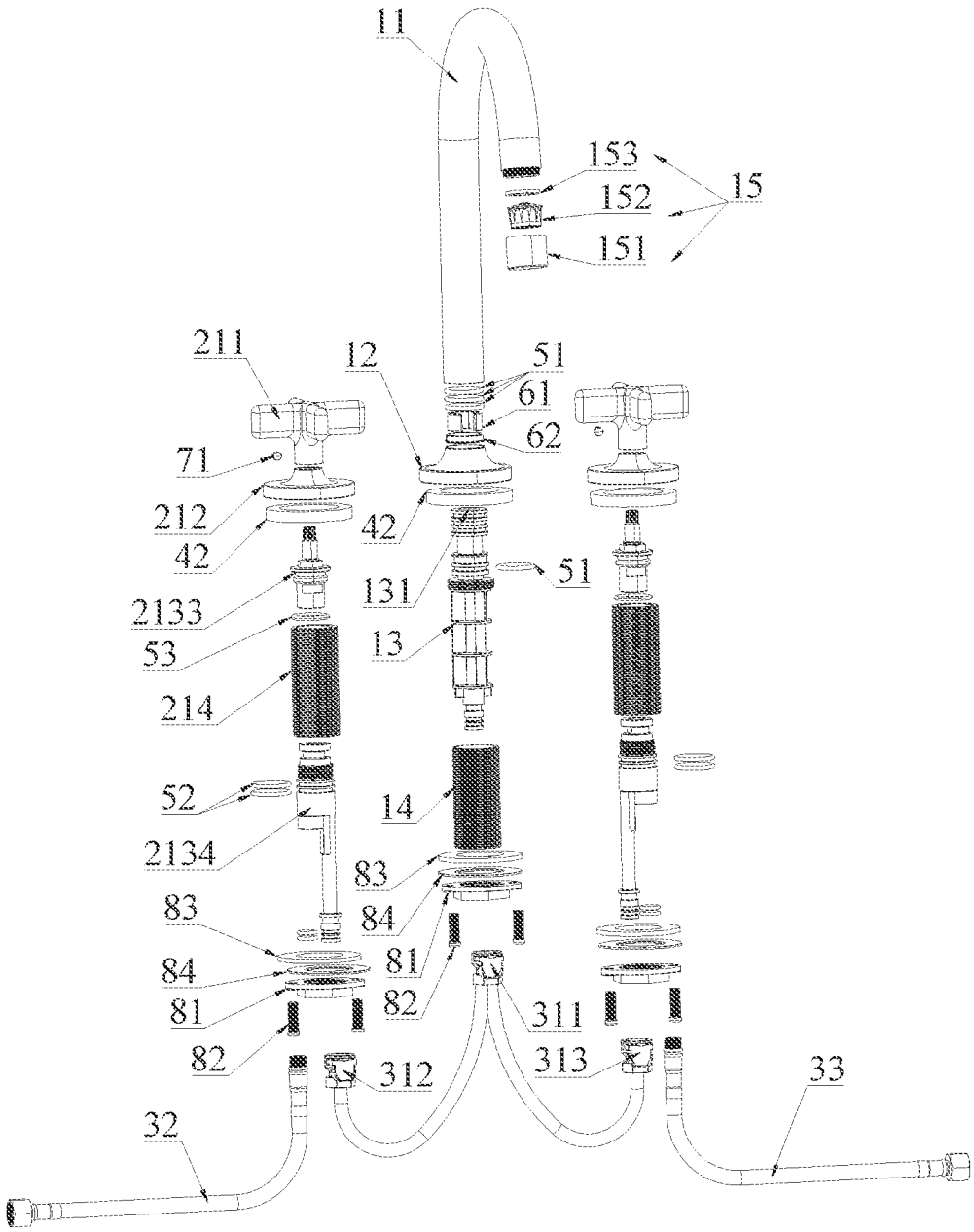
FIG. 2 shows an exploded view of FIG. 1.
Figure 6:
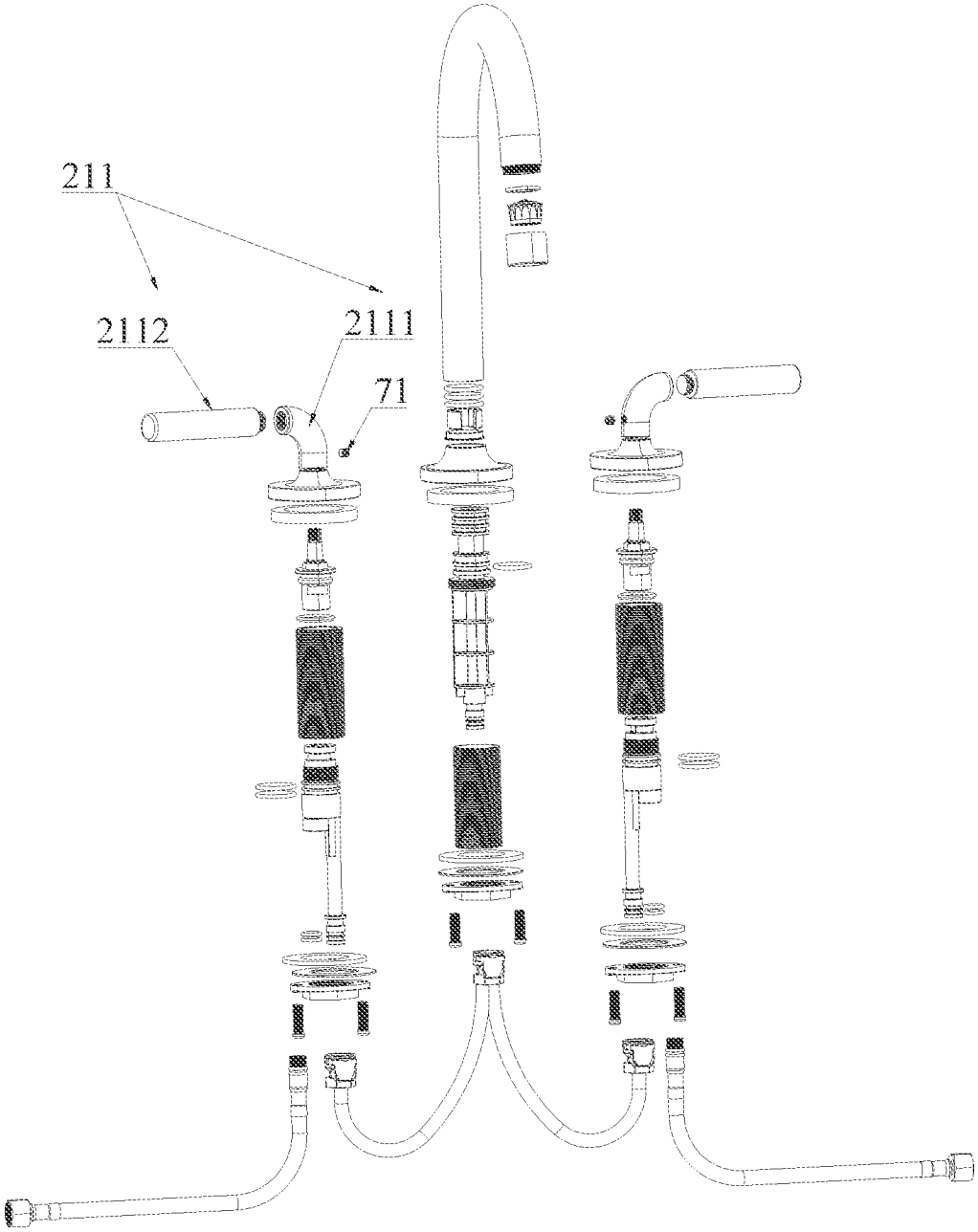
FIG. 6 shows an exploded view of FIG. 5.
Figure 7:
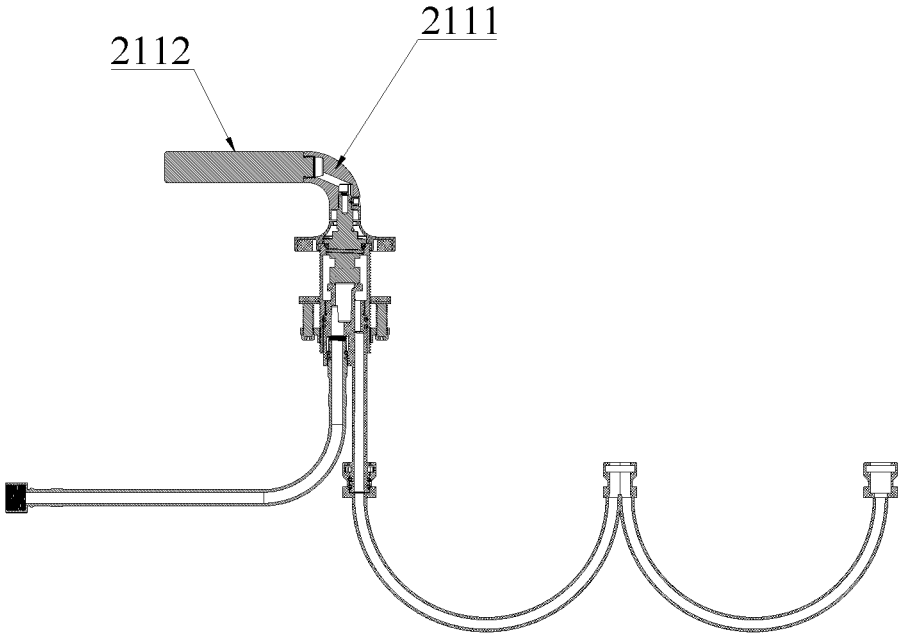
FIG. 7 shows a cross-sectional view of the control unit and pipeline assembly of FIG. 5.

Referring to FIGS. 1-2 and 6, the control unit 2 includes two handle assemblies 21, which are typically arranged on either side of the water outlet assembly 1, and all three are typically arranged in the same straight line. The handle assemblies 21 include a handle 211, a second mounting base 212, a copper core 2133, a plastic core 2134 and a second sleeve 214; the second sleeve 214 is sleeved outside the copper core 2133 and the plastic core 2134, the copper core 2133 is arranged above the plastic core 2134, and both the copper core 2133 and the plastic core 2134 are screwed to the second sleeve 214, the second mounting base 212 is sleeved outside the second sleeve 214 and the plastic core 2134, and is connected to the second sleeve 214 in a threaded manner; the plastic core 2134 is provided with a fluid inlet port 2131 and a fluid outlet port 2132, the copper core 2133 is partially exposed from the second sleeve 214 and is connected to the handle 211, and a connection/disconnection between the fluid inlet port 2131 and the fluid outlet port 2132 can be controlled by operating the handle 211. According to practical needs, referring to FIGS. 1-4 and 5-7, the shape of the handle 211 can be cross-shaped, i.e., the handle 211 is a cross handle 211, and the cross handle 211 is made of zinc alloy; or the shape of the handle 211 can be a cylindrical arc shape, i.e., the handle 211 is a circular arc handle 211, and the circular arc handle 211 comprises a handle connector 2111 and a handle straight rod 2112, and the handle connector 2111 is connected to the copper core 2133, the handle connector 2111 is made of zinc alloy, and the handle straight rod 2112 is made of stainless steel; it is to be emphasized that the present disclosure does not restrict the specific shape of the handle 211, as long as it is able to realize the function of the handle 211. To ensure the reliability of the use of the handle 211, the handle 211 and the copper core 2133 can be connected to each other by screw 71.

Figure 3:
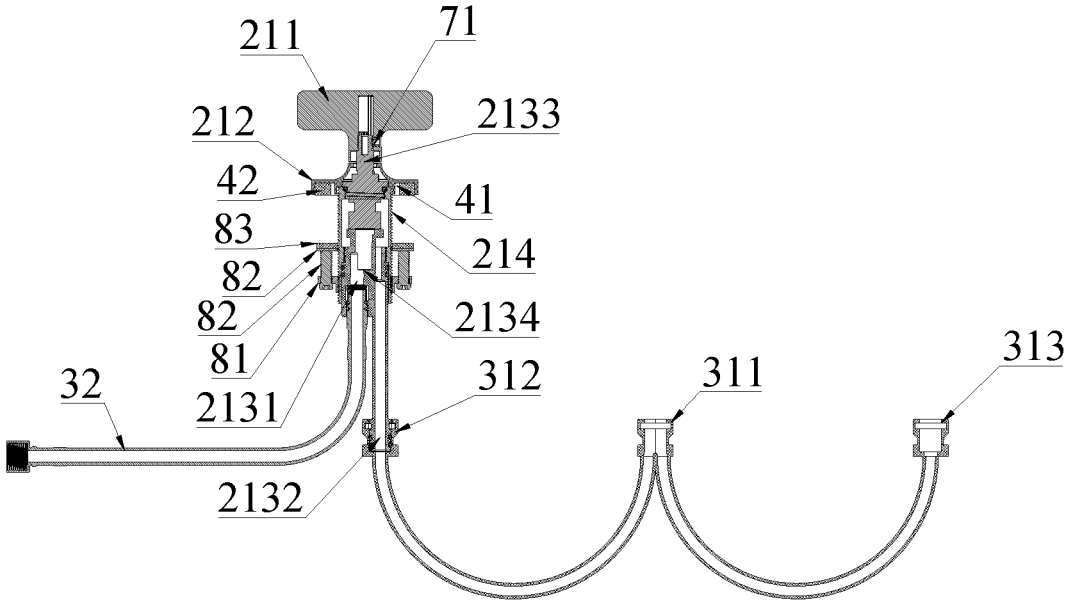
FIG. 3 shows a cross-sectional view of the control unit and pipeline assembly of FIG. 1.

Referring to FIGS. 1-3, the pipeline assembly 3 includes a hot water inlet pipe 32, a cold water inlet pipe 33, and a quick connecting pipe; the quick connecting pipe has three connectors, namely a first connector 311, a second connector 312 and a third connector 313; the first connector 311 is connected to the second connector 312 and the third connector 313 respectively; the first connector 311 is connected to the second end of the connecting core body 13, the second connector 312 and the third connector 313 are connected to the fluid outlet ports 2132 of two plastic cores 2134 respectively, and the fluid inlet ports 2131 of two plastic cores 2134 are connected to the hot water inlet pipe 32 and the cold water inlet pipe 33, respectively.

Wherein, the first mounting base 12 and the second mounting base 212 are made of zinc alloy, and the first sleeve 14 and second sleeve 214 are made of stainless steel.

In the above-described setting method, the plastic core 2134 is made of plastic, so when the hot water flows through the plastic core 2134, it can play the role of heat insulation, thus reducing the risk of scalding people by the handle 211, i.e., it has a certain anti-scald effect. And the plastic core 2134 has a better corrosion resistance, and is not easily affected by water quality so that it is not easily to be oxidized and corroded. In addition, due to the use of the plastic core 2134, the plastic core 2134 is not prone to freezing and cracking when the temperature is below zero degrees Celsius, and has a better anti-freezing effect. The second mounting base 212, the first mounting base 12 and the handle 211 are all made of zinc alloy (i.e., metal casing and plastic core), which can ensure the structural strength of the double-handle faucet of the present disclosure, and the second sleeve 214 of the stainless steel material is wrapped outside of the plastic core 2134, so that the plastic core 2134 can be free from the external force during installation, i.e., it plays the role of protecting the plastic core 2134. At the same time, the plastic core 2134 with a metal shell can also make the production cost lower.

As a preferred embodiment, the connecting core body 13 is made of plastic. Similarly, the connecting core body 13 is made of plastic to reduce production costs and avoid oxidative corrosion due to water quality; and the first sleeve 14 is made of stainless steel to protect the connecting core body 13.

Preferably, the first sleeve 14 and the connecting core body 13 are threaded with the first mounting base 12. By means of the threaded connection, it can be easily disassembled.

Figure 4:
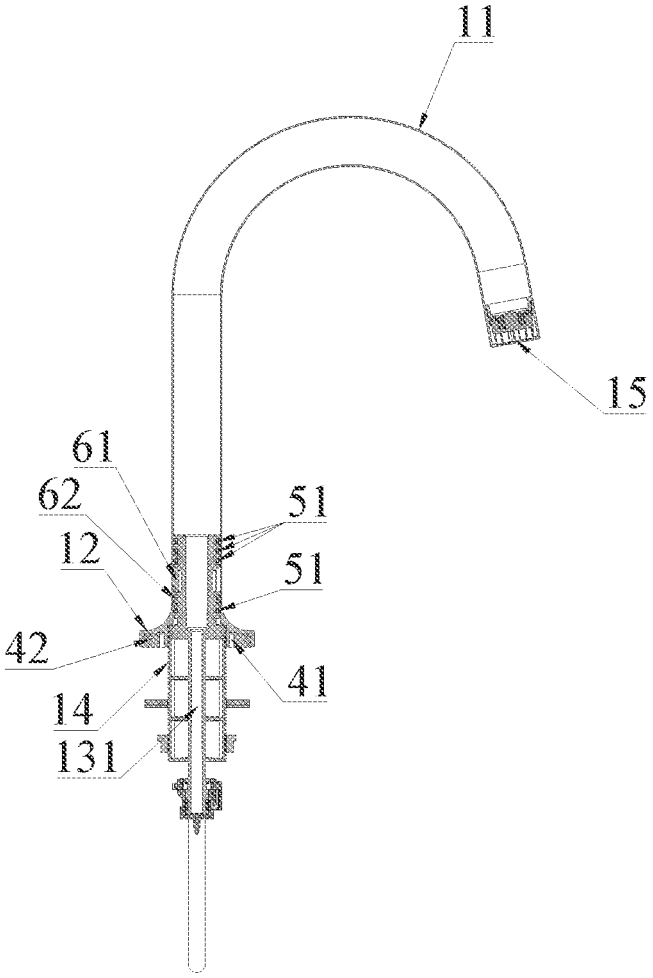
FIG. 4 shows a schematic view of the water outlet assembly of FIG. 1.
Figure 5:
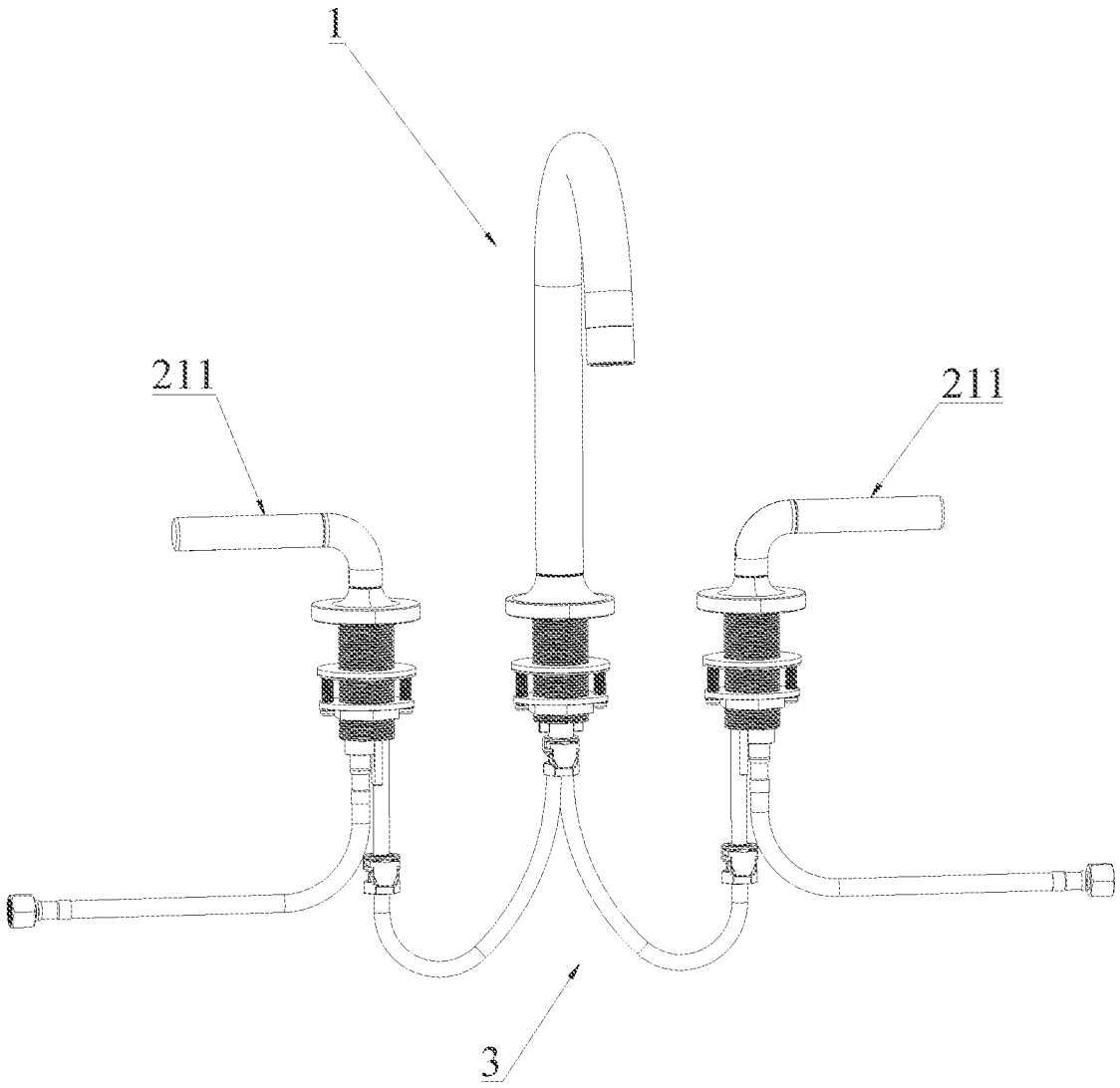
FIG. 5 shows a three-dimensional schematic view of another embodiment of a double-handle faucet of the present disclosure.

Preferably, with reference to FIGS. 3-4, the bottom surfaces of the first mounting base 12 and the second mounting base 212 are provided with an annular groove 41, and a spacer 42 is provided in the annular groove 41, and the height of the spacer 42 is greater than the depth of the annular groove 41. By providing the spacer 42, a cushioning effect can be played between the first mounting base 12 and the basin (washbasin), so as to avoid the basin (washbasin) from being knocked and damaged.

Preferably, with reference to FIGS. 1-4, the water outlet pipe 11 is sleeved on the first end of the connecting core body 13, and three first sealing rings 51 are provided between the connecting core body 13 and the water outlet pipe 11. One first sealing ring 51 is provided between the connecting core body 13 and the first mounting base 12. By providing the first sealing rings 51, it can play a role in enhancing sealing effect and avoiding water leakage. Specifically, the number of the first sealing ring 51 can be set according to the actual need.

Preferably, with reference to FIGS. 3-4, an opening circlip 61 is also provided on the first end of the connecting core body 13, and the opening circlip 61 is arranged between the connecting core body 13 and the water outlet pipe 11. Specifically, the opening circlip 61 is a plastic part, by means of the opening circlip 61 the water outlet pipe 11 can be reliably mounted on the first end of the connecting core body 13. In order to reduce wear and tear between the water outlet pipe 11 and the connecting core body 13, a wear-resistant plastic ring 62 can be provided between the first end of the connecting core body 13 and the water outlet pipe 11.

Preferably, referring to FIG. 2, a second sealing ring 52 is provided between the plastic core 2134 and the second sleeve 214, and a third sealing ring 53 is provided between the copper core 2133 and the second sleeve 214. By providing the second sealing ring 52 and the third sealing ring 53, a sealing effect can be provided to reduce the possibility of water leakage between the copper core 2133, the plastic core 2134 and the first sleeve 14. And the number of the second sealing ring 52 and the third sealing ring 53 can be set according to the actual need, for example, the second sealing ring 52 is set as two, and the third sealing ring 53 is set as one.

Preferably, with reference to FIG. 2, the outside of the first sleeve 14 and the second sleeve 214 are threaded with a locking nut 81, the locking nut 81 can move in its own axial direction when it is twisted(screwed or unscrewed), that is, when the locking nut 81 is twisted, the locking nut 81 can be close to or away from the basin (hand washing station), the locking nut 81 is threaded with at least two flathead screws 82, and the small end of the flathead screws 82 on the first sleeve 14 is set toward the first mounting base 12, and the small end of the flathead screws 82 on the second sleeve 214 is set toward the second mounting base 212, and the outside of the first sleeve 14 and the second sleeve 214 are also sleeved with a silicone washer 83 and a stainless steel washer 84 stacked on top of each other, and the stainless steel washer 84 is closer to the flathead screws 82. In this way, the locking nut 81 on the first sleeve 14 is made to move to a suitable position to the bottom of the basin (washbasin) by twisting it, and then twisting the flat head screw 82 to tighten the silicone washer 83 onto the bottom surface of the basin (washbasin), at this time the basin (washbasin) will be clamped between the silicone washer 83 and the first mounting 12, which can play a role in fixing the water outlet assembly 1; similarly, by twisting the locking nut 81 on the second sleeve 214, it is moved to a suitable position to the bottom surface of the basin (washbasin), and then by twisting the flat head screw 82, the silicone washer 83 is tightened against the bottom surface of the basin (washbasin); at this time the basin (washbasin) will be clamped between the silicone washer 83 and the second mounting seat 212, which can play a role in fixing the control unit 2.

The above is only an embodiment of the present disclosure, not to limit the patent scope of the present disclosure, where the equivalent structure or equivalent process transformation based on the specification and the accompanying drawings of the present disclosure, or directly or indirectly used in other related technical fields, are included in the patent protection scope of the present disclosure.

The invention claimed is:

1. A double-handle faucet, comprising:

a water outlet assembly, comprising a water outlet pipe, a water outlet spout, a first mounting base, a connecting core body and a first sleeve, a water outlet channel being provided in the connecting core body, the first sleeve being sleeved outside the connecting core body, and a first end of the connecting core body being exposed from the first sleeve, the first mounting base being sleeved outside the first sleeve and the connecting core body, the first sleeve and the connecting core body being connected with the first mounting base respectively, the water outlet pipe is provided at the first end of the connecting core body and connected to the water outlet channel, the water outlet spout is provided at one end of the water outlet pipe away from the connecting core body;

a control unit, comprising two handle assemblies, the handle assemblies comprising a handle, a second mounting base, a copper core, a plastic core, and a second sleeve respectively, the second sleeve being sleeved outside the copper core and the plastic core, the copper core being arranged over the plastic core, the copper core and the plastic core both being connected to the second sleeve in a threaded manner, the second mounting base being sleeved outside the second sleeve and the plastic core, and being connected to the second sleeve in a threaded manner, the plastic core is provided with a fluid inlet port and a fluid outlet port, the copper core is partially exposed from the second sleeve and is connected to the handle, so that a connection/disconnection between the fluid inlet port and the fluid outlet port can be controlled by operation of the handle;

a pipeline assembly, comprising a hot water inlet pipe, a cold water inlet pipe and a quick connecting pipe; the quick connecting pipe having three connectors, namely a first connector, a second connector and a third connector; the first connector being connected with the second connector and third connector respectively, the first connector being connected with a second end of the connecting core body, the second connector and the third connector being connected with the fluid outlet ports of two plastic cores respectively; the fluid inlet ports of the two plastic cores are connected to the hot water inlet pipe and the cold water inlet pipe respectively;

wherein, the first mounting base and the second mounting base are made of zinc alloy, and the first sleeve and the second sleeve are made of stainless steel, wherein a locking nut is threaded outside the first sleeve and the second sleeve respectively, the locking nut is able to move in its own axial direction when twisted, at least two flathead screws are connected on the locking nut in a threaded manner, and the small end of the flathead screw provided on the first sleeve is set toward the first mounting base, and the small end of the flathead screw provided on the second sleeve is set toward the second mounting base, a silicone washer and a stainless steel washer stacked on top of each other are sleeved outside the first sleeve and the second sleeve, and the stainless steel washer is closer to the flathead screw; the pipeline assembly further comprises a hot water inlet pipe and a cold water inlet pipe, and the fluid inlet ports of two valve cores are connected to the hot water inlet pipe and the cold water inlet pipe, respectively.

2. The double-handle faucet according to claim 1, wherein the connecting core body is made of plastic.

3. The double-handle faucet according to claim 1, wherein the first sleeve and the connecting core body are connected to the first mounting base in a threaded manner.

4. The double-handle faucet according to claim 1, wherein a bottom surface of the first mounting base and the second mounting base are provided with an annular groove, a spacer is provided in the annular groove, the height of the spacer is greater than the depth of the annular groove.

5. The double-handle faucet according to claim 1, wherein the water outlet pipe is sleeved on the first end of the connecting core body and three first sealing rings are provided between the connecting core body and the water outlet pipe, and one first sealing ring is provided between the connecting core body and the first mounting base.

6. The double-handle faucet according to claim 5, wherein the connecting core body is provided with an opening circlip, the opening circlip is provided between the connecting core body and the water outlet pipe.

7. The double-handle faucet according to claim 1, wherein a second sealing ring is provided between the plastic core and the second sleeve, and a third sealing ring is provided between the copper core and the second sleeve.

8. The double-handle faucet according to claim 1, wherein the handle is a cross handle, the cross handle is made of zinc alloy.

9. The double-handle faucet according to claim 1, wherein the handle is a circular arc handle, the circular arc handle comprises a handle connector and a handle straight rod, the handle connector is connected to the copper core, the handle connector is made of zinc alloy and the handle straight rod is made of stainless steel.

* * * * *